US008232749B1

(12) United States Patent
Barov et al.

(10) Patent No.: US 8,232,749 B1
(45) Date of Patent: Jul. 31, 2012

(54) DUAL SLOT RESONANCE COUPLING FOR ACCELERATORS

(75) Inventors: Nikolai Barov, La Jolla, CA (US); Roger H Miller, Mountain View, CA (US)

(73) Assignee: Far-Tech, Inc., San Diego, CA (US)

( * ) Notice: Subject to any disclaimer, the term of this patent is extended or adjusted under 35 U.S.C. 154(b) by 310 days.

(21) Appl. No.: 12/754,496

(22) Filed: Apr. 5, 2010

Related U.S. Application Data

(60) Provisional application No. 61/166,983, filed on Apr. 6, 2009.

(51) Int. Cl.
*H01J 25/10* (2006.01)
*H01J 9/00* (2006.01)

(52) U.S. Cl. ..... 315/505; 315/5.41

(58) Field of Classification Search ..... 315/5.41–544, 315/500–505

See application file for complete search history.

(56) References Cited

U.S. PATENT DOCUMENTS 4,024,426 A * 5/1977 Vaguine ..... 315/5.41
4,438,367 A * 3/1984 Kerns et al. ..... 315/5.41

* cited by examiner

*Primary Examiner* — Don Le
(74) *Attorney, Agent, or Firm* — Elizabeth Kim

(57) ABSTRACT

A pair of cavities defined within a hollow elongate accelerator body include a first resonant cavity having a first resonant slot through an outer wall thereof, and a second resonant cavity having a second resonant slot through an outer wall thereof. The first resonant slot and the second resonant slot are separated by a void region that extends between the outer wall of the first cavity and the outer wall of the second cavity and is bounded in part by an inner surface of the hollow elongate member. The first and second cavities are coupled to each other through a dual slot coupling structure that includes the first resonant slot, the void region, and the second resonant slot.

22 Claims, 1 Drawing Sheet

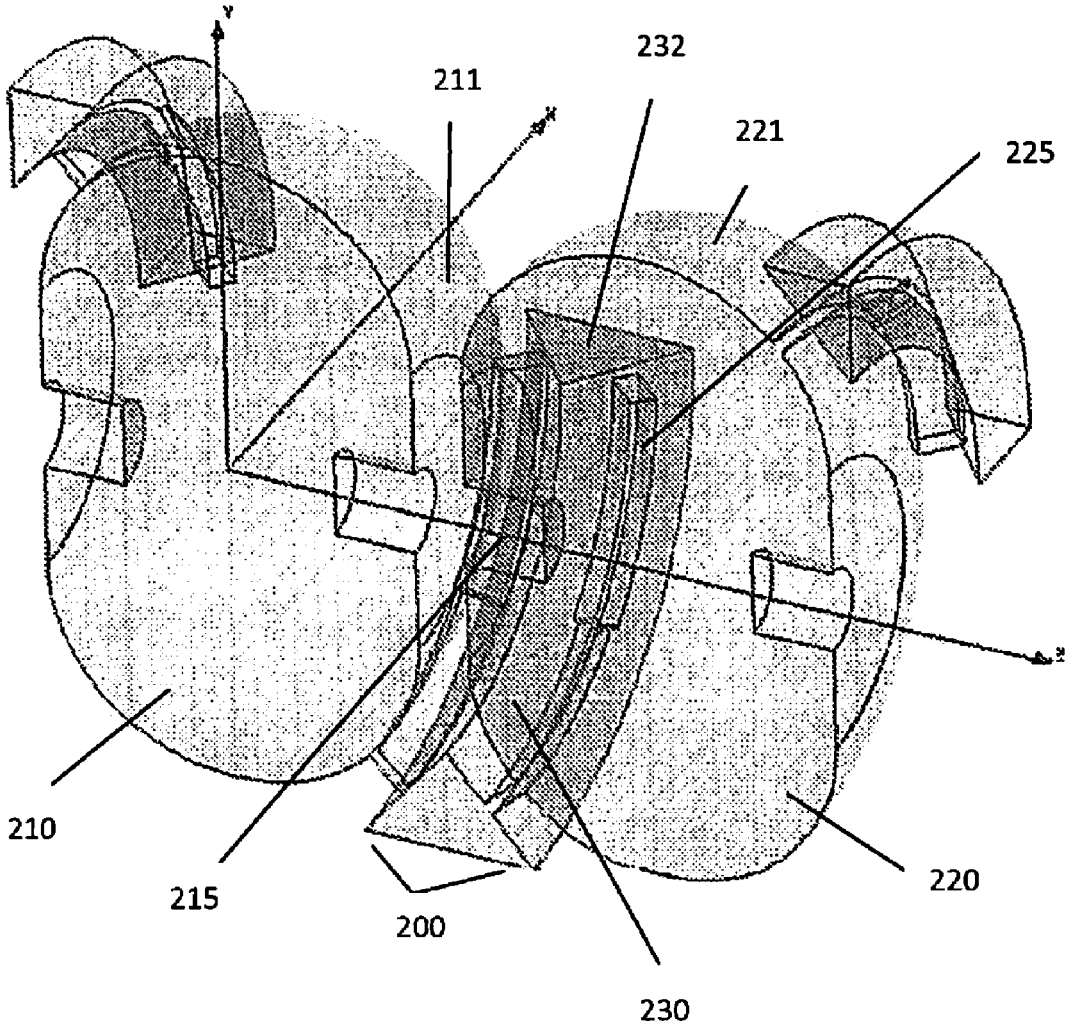
232
211
221
225
210
215
200
230
220

DUAL SLOT RESONANCE COUPLING FOR ACCELERATORS

CROSS-REFERENCE TO RELATED APPLICATIONS

The present application is based upon, and claims the benefit of priority under 35 U.S.C. §119, to U.S. Provisional Patent Application No. 61/166,983 (the "'983 provisional application"), filed Apr. 6, 2009 and entitled "Dual Slot Resonance Coupled Accelerating Structure." The content of the '983 provisional application is incorporated herein by reference in its entirety as though fully set forth.

BACKGROUND

Charged particle accelerators (including but not limited to linear particle accelerators) make wide use of RF resonant cavity structures. In these structures, RF power is directed to one or more resonant cavities, which are connected by a beam tube that allows charged particles to pass through each cavity. As a beam of particles traverses the acceleration gap in each cavity, it is accelerated by the voltage across the acceleration gap.

A linear particle accelerator (commonly referred to as a linac) is a type of particle accelerator that greatly increases the velocity of charged particles by subjecting them to oscillating electric fields along a beamline. Linacs have many applications, including but not limited to the generation of X-rays for medicinal purposes, the injection of particles for higher-energy accelerators, and the investigation of the properties of subatomic particles.

The design of a linac generally depends on the type of particle that is being accelerated, e.g. electrons, protons, or ions. Currently, common choices for industrial and medical electron linacs include the biperiodic design and the SCL (side-coupled linac) design. The final beam energy in these machines is typically in the 10-30 MeV range.

A linac design for these applications which results in better functionalities, including but not limited to RF efficiency, higher rates of acceleration, smaller weight or volume, easier manufacturability, and enhanced reliability, is desirable for many applications.

BRIEF DESCRIPTION OF DRAWINGS

The drawing figures depict one or more implementations in accordance with the concepts disclosed herein, by way of example only, not by way of limitations.

The drawings disclose illustrative embodiments. Other embodiments may be used in addition or instead.

FIG. 1 illustrates two adjacent resonant cavities that are coupled by a dual slot coupling structure in accordance with one embodiment of the present disclosure.

DETAILED DESCRIPTION

In the present disclosure, methods and systems are described relating to dual slot resonance coupling in accelerators.

In general, acceleration structures include traveling wave accelerators and standing wave accelerators. One example of a standing wave linear accelerator system is illustrated in FIG. 4 of published U.S. patent application No. 20090302785 (the "'785 application"). The contents of the '785 application is incorporated herein by reference in its entirety.

In overview, the accelerator system illustrated in FIG. 4 of the '785 application includes a hollow elongate accelerator body extending along a beam axis, and a plurality of pairs of coupled resonant cavities, the cavities defined within the hollow elongate accelerator body. Each pair of cavities includes a first resonant cavity coupled to a second resonant cavity.

The accelerator system illustrated in FIG. 4 of the '785 application, further includes an RF source 34 which generates RF power and directs the RF power to the resonant cavities. Examples of RF sources 34 include, but are not limited to, RF power supplies such as klystrons and magnetrons, and typically produce an RF input signal having a power level on the order of hundreds of kilowatts. The resonant cavities are connected by a beam tube that allows charged particles (which typically form a beam) to pass through each cavity. As illustrated, the RF source 34 may be connected to the accelerator body by a waveguide 36. A source of charged particles, for example an electron gun 32, injects a stream of charged particles into the cavities. Typically, the electrons are accelerated to an initial energy of about 10 keV to about 50 keV.

The sizes of the cavities in the accelerator system illustrated in FIG. 4 of the '785 application are matched to the wavelength of the RF input signal, so that the electric and magnetic field patterns generated by the RF input signal repeat periodically along the accelerator.

In a standing wave accelerator such as illustrated in FIG. 4 of the '785 application, each resonant cavity is configured to support an RF standing wave therewithin when provided with RF power from the RF source 34. The shape and size of an RF resonant cavity determines the frequency and mode for which it resonates. All of the plurality of cavities in the accelerator system are configured and arranged so as to resonate at substantially the same frequency.

In a standing wave accelerator such as the accelerator illustrated in FIG. 4 of the '785 application, each resonant cavity includes an accelerating gap defined therewithin. When RF power is received from the RF source, the voltage difference across the accelerating gap causes charged particles to be accelerated when they traverse the gap.

As the particle beam traverses the acceleration gap in each cavity, the beam is accelerated by the voltage across the acceleration gap. Since the gap voltages have a sinusoidal variation as a function of time, the phasing angle in each cavity voltage is designed to be such that it results in maximum acceleration at the time of particle crossing.

A standing wave structure typically has one input coupler, and the upstream and downstream ends of the structure include some means for reflecting the wave. On the other hand, in a traveling wave structure power is introduced at an input coupler at one end and absorbed at the other end. In a standing wave structure, only a set of well-defined frequencies, which match the resonance condition, are allowed. These frequencies occur on the previously continuous passband.

In the standing wave linear accelerator illustrated in FIG. 4 of the '785 patent application, reflective end cavities and are disposed at opposite ends of the accelerator body. The reflective end cavities reflect the input signal (provided by the RF power source) in the accelerator body, in such a way that a standing wave is maintained in the accelerator body as a whole, as a result of the constructive interference of waves traveling in opposite directions from one another. These end cavities have a coupling structure only on one end.

The string of coupled cavities 140 behaves as a transmission line, also referred to as a waveguide in the art. An infinitely long transmission line has a cutoff frequency, below which no signal can propagate. Above that, a set of passbands occur indicating a frequency range that allows signal transmission. A passband is characterized in terms of its dispersion curve characteristics. A dispersion curve plots the relationship between the frequency of the input signal and the phase advance $\Delta\Phi$. In the present disclosure, the term "phase advance" refers to the change in RF phase angle from one resonator to the next in the transmission line, where examples of resonators include without limitation: a cavity; a single resonant slot; or a collective mode occurring in a dual resonant slot structure.

It is desirable that the RF angle at each cavity gap be such that the bunch of charged particles pick up the maximum amount of energy from each gap. In other words, the goal is to have the particles arrive in each cavity of the accelerator just at the right time to get maximum push from the electric field in the cavity.

If the species of the particles being accelerated is electrons, the structure is often optimized for a phase velocity equal to the speed of light. Because electrons are light particles, they are very quickly accelerated to a speed very close to the speed of light, with the initial acceleration often takes place on only the first cell. Proton and heavy ion accelerators are designed for a different phase velocity, and that phase velocity is made to change along the length of acceleration as the particle velocity increases.

In order to efficiently provide RF energy to the accelerating cavities, coupled-cavity systems that allow a single RF source to feed a large number of cavities (up to several hundred) are widely implemented. Two cavities that are in proximity to one another may be coupled by opening up a coupling slot between the two cavities.

A resonant slot between adjacent cavities can be used to couple them together. Single slot resonance coupling is disclosed in the '785 patent application.

The accelerator illustrated in FIG. 4 of the '785 application shows an acceleration structure with cylindrical cavity walls. In this structure, the cavities are defined by a series of transverse interior walls within a cylindrically shaped hollow accelerator body, and each interior wall includes a pair of tubular nose cones.

In the present disclosure, a dual resonance slot coupling structure is disclosed, which is illustrated in FIG. 1. Referring to FIG. 1, two adjacent resonant cavities are shown, which are defined within a hollow elongate member (such as the accelerator body described in conjunction with FIG. 4 of the '785 application), and which are coupled to each other by a dual slot coupling structure 200 in accordance with one embodiment of the present disclosure.

For clarity, FIG. 1 illustrates a simplified geometry, showing no beam pipe hole and showing only a couple of cylinders in either side of the gap region. An actual accelerator typically includes nose cones as described in the '785 application. The simplified geometry illustrated in FIG. 1 reduces computer modeling time, and is based on an "equivalent capacitance" model, i.e. the cavity frequency and outer wall dimensions would be the same given the addition of proper nose cones.

The pair of resonant cavities shown in FIG. 1 includes a first resonant cavity 210 having a first resonant slot 215 cut through its outer wall 211, and a second resonant cavity 220 adjacent the first resonant cavity 210 and having a second resonant slot 225 cut through its outer wall 221. The pair of resonant cavities shown in FIG. 1 includes a first resonant cavity 210 having a first resonant slot 215 cut through its outer wall 211, and a second resonant cavity 220 adjacent the first resonant cavity 210 and having a second resonant slot 225 cut through its outer wall 221.

As seen in FIG. 1, the first resonance slot 215 is between the first cavity and a small void region 230, and the second resonance slot 225 is between the void region 230 and the second cavity. In other words, the first resonant slot 215 and the second resonant slot 225 are separated by a void region 230 that extends between the outer wall of the first cavity 210 and the outer wall of the second cavity 220, and is bounded in part by the interior surface of the hollow elongate member.

The first cavity 210 and the second cavity 220 are coupled to each other through the dual resonance slot coupling structure 200, which comprises the first resonant slot 215, the void region 230, and the second resonant slot 225.

In the embodiment illustrated in FIG. 1, the outer walls of both of the coupled cavities are curved. As seen in FIG. 1, a cross section 232 of the void region 230 has a substantially triangular configuration that fits between the curved outer walls of the first and second cavities and an inner surface of the hollow elongate member, thus allowing the void region 230 to wrap around and span both cavities 210 and 220. In the illustrated embodiment, the void region 230 is configured to span the first and second cavities by about 180 degrees in an azimuthal direction.

FIG. 1 depicts only half the geometry, with the cavities in the negative X coordinate not shown for clarity, but having left-right (negative to positive X) symmetry. The beam tube is also not shown in FIG. 1, for clarity. FIG. 1 shows half of the void and slot structure that would be used to couple to the cavities that come before and after the two depicted in the drawing.

In the geometry illustrated in FIG. 1, the triangular cross section 232 of the void region naturally fits between the curved outer walls of the cavities, and therefore makes efficient use of space. The coupling cells of an SCL, for example, typically result in a much wider structure, where the radius might be 50% larger.

Because the void region 230 strongly couples the two slot modes, and raises the frequency of the higher one (which is the one that must be used for the coupling), it can be challenging to tune the slot frequency to be compatible with the acceleration cavity frequency. The geometry or other characteristics of the coupling structure (two slots separated by a void region) can be adjusted in order to tune the slots to the correct frequency. Examples of geometry adjustments include but are not limited to: increasing the length of the slots, using deeper slots with a thicker section of material between the cavities and the void regions, and increasing the size of the void region.

In some embodiments, one or more of the slots may be capacitively loaded in order to limit their angular extent. In particular, the middle of each slot may be capacitively loaded, by way of example.

In some other embodiments, one or more of the slots may have a geometrical configuration that closes back on themselves in the shape of the letter C.

For a standing-wave acceleration structure, the most often used choices of the phase advance $\Delta\Phi$ per cavity are $\pi$ and $\pi/2$. Zero phase advance per cavity is also sometimes used. In the case of $\Delta\Phi=\pi$, the longitudinal separation between the gaps is $\lambda/2$, where $\lambda$ is the free space RF wavelength. However, since the dispersion curve near $\pi$-mode has zero slope as a function of frequency, there is an increased chance for a nearby mode to be close in frequency to the intended mode. Since the number of modes or eigenvalues in the dispersion curve are equal to the number of cavities in the accelerator structure, this design favors a relatively small number of cavities, often less than nine.

In the case of $\Delta\Phi=\pi/2$, every other resonant cavity is "dead," or relatively empty of RF fields. As such it cannot contribute to the acceleration of the beam of charged particles. In commonly used SCL design, these cavities are put off to the side so that they do not take space along the beam path. Since the coupling cavities are dead, their design does not have to be optimized to conserve RF power, and they are usually made much smaller than the on-axis cavities.

Another $\Delta\Phi=\pi/2$ structure is the bi-periodic structure, in which the coupling cavities are made very short along the beam propagation direction, and placed between the acceleration cavities, which are made as long as is possible. Because the dispersion curve has the steepest slope near $\Delta\Phi=\pi/2$, linac structures of this type have used a large number of cavities for a single RF feed, in some cases as many as several hundred.

In the dual slot resonance coupling structure 200 described in the present disclosure and illustrated in FIG. 1, the two resonance slots 215 and 225 are in close proximity so that their magnetic fields couple together, resulting in two collective modes in which the two slots oscillate in phase and out of phase, respectively. The two modes have different frequencies due to the coupling.

As described earlier, in the embodiment illustrated in FIG. 1 one resonance slot 215 is between the first cavity 210 and the small void region 230, and the second resonance slot is between the void region 230 and the next adjacent cavity, namely the second cavity 220. If all the magnetic field from both slot modes is forced into the void region 230, a large frequency split results between the two slot modes.

With the adjacent first and second cavities are detuned, the two slots have an in-phase and an out-of-phase mode, and the ratio of the two mode frequencies can be almost 2:1. Therefore, the in-phase mode will not interfere with any nearby cavities which are tuned near the out-of-phase mode.

An alternative way to look at the dual slot structure is as two resonators in which case it can be concluded that it is resonating in a $\pi/3$ mode, with an overall it phase advance from one cavity to the next. The structure is, however, better viewed as a single resonator that supports two modes, which makes the phase advance $\pi/2$.

In one embodiment of the present disclosure, the cavities are shaped and sized so that the center-to-center spacing defined by successive ones of the accelerating gaps within adjacent cavities is about $\beta\pi/2$, where $\lambda$ is the free space wavelength of the resonant standing wave in the cavities and $\beta$ is the velocity of a particle passing through the cavity, normalized to the speed of light. In this embodiment, the electric fields (resulting from the input signal from the RF source) in the acceleration gaps of adjacent cavities are out of phase, i.e. reversed in direction, with respect to each other.

In one or more embodiments of the present disclosure, each dual slot coupling structure is located at alternate azimuthal angles of zero and 180 degrees as shown in FIG. 1, thus reducing the dipole mode which would be present if all the slots were placed on the same side of the cavities. Such a dipole mode is undesirable because it would steer the beam of particles.

The dual slot coupling structure 200 described above may be tuned so that the dispersion curve is closed, analogous to the case of an SCL. In other words, the sizes, shapes, and resonant frequencies of the resonant cavities and the resonant slots can be selected so as to close the dispersion curve for the transmission line near a desired operating mode for the system, with adjacent accelerating gaps having electric fields that are out of phase. In one embodiment, the above-described coupling structure results in RF losses of about 15%, which is similar to the case of an SCL.

In one example of an RF model simulation, performed using the program HFSS published by Ansoft Corp. (now a part of Ansys), the cavity resonant frequency was about 3 GHz. The cavity outer radius was at 3.94 cm, while the space between cavities was 6 mm. The gap was $\lambda/4$, and the radius of the gap region was 5 mm. The radial extent of the triangular void region was 12.5 mm, while the longitudinal extent was 20 mm. The void region spanned 180 degrees around the cavity. The depth of the first and second resonance slots was 5.5 mm, while the width was 1.5 mm near the center of the slot and 3 mm toward the edges. The central region spanned 48 degrees, while each of the side regions spanned 45 degrees.

Variations of the geometry depicted in FIG. 1 are possible, as explained earlier. For example, the void region is not limited to a triangular cross-section, and may have an arbitrary cross sectional shape. The two slots can have any shape that allows them to have the correct resonant frequency, and for the pair of slots to have the correct set of frequencies.

The cavities can be made of any shape that corresponds to an acceptable geometry as an accelerator cavity. Variations in the basic design include, without limitation, cavities that have a flat (non-curved) outer wall, and cavities that have no nose-cones and bigger irises. A cavity with bigger irises has reduced wake-field forces, which can be a benefit in some accelerator applications.

In some embodiments of the present disclosure, methods relating to dual resonance slot coupling are disclosed, including: aligning a plurality of pairs of adjacent cavities along a beam axis; for each pair, forming a resonant slot on the outer walls of each adjacent cavity, and separating the resonant slots by a void region that wraps around and spans both cavities by about 180 degrees in the azimuthal direction along the beam axis, thereby generating a dual slot coupling structure that includes the two resonant slots and the void region, and that couples the adjacent cavities to each other; and providing RF power to the plurality of cavities, causing the magnetic fields in the resonant slots in each coupling structure to be coupled and to become confined within the void region, and further causing the dual slot coupling structure to resonate in one or more collective modes in which the electric fields in acceleration gaps defined within the adjacent cavities are out of phase and reversed in direction with respect to each other.

In sum, methods and systems have been disclosed relating to dual slot resonance coupling in accelerator systems. The acceleration structures depicted in the present disclosure is competitive with existing designs for the purpose of electron acceleration in applications that include but are not limited to medical and industrial linacs. The dual slot resonance coupling disclosed in the present application provides provide a large amount of coupling, which leads to a wider frequency band, and a steeper dispersion curve near $\pi/2$. Therefore, one or more of the mechanical tolerances of the device may be relaxed, and the device may be easier to tune. The accelerator structures disclosed above can fit within small spaces, and have shunt impedances competitive with existing structures.

It should be noted that various changes and modifications to the embodiments described herein will be apparent to those skilled in the art. Such changes and modifications may be made without departing from the spirit and scope of the present disclosure and without diminishing its attendant advantages.

The components, steps, features, objects, benefits and advantages that have been discussed are merely illustrative.

None of them, nor the discussions relating to them, are intended to limit the scope of protection in any way. Numerous other embodiments are also contemplated, including embodiments that have fewer, additional, and/or different components, steps, features, objects, benefits and advantages. The components and steps may also be arranged and ordered differently.

Nothing that has been stated or illustrated is intended to cause a dedication of any component, step, feature, object, benefit, advantage, or equivalent to the public.

What is claimed is:

1. A system comprising:

a pair of cavities defined within a hollow elongate member, the pair including a first resonant cavity having a first resonant slot through an outer wall thereof, and a second resonant cavity having a second resonant slot through an outer wall thereof;

wherein the first resonant slot and the second resonant slot are separated by a void region that extends between the outer wall of the first cavity and the outer wall of the second cavity and is bounded in part by an inner surface of the hollow elongate member; and wherein the second cavity is coupled to the first cavity through a dual slot coupling structure that includes the first resonant slot, the void region, and the second resonant slot.

2. The system of claim 1, wherein the outer wall of at least one of the cavities is curved.

3. The system of claim 1, wherein the outer walls of both cavities are curved; and wherein a cross section of the void region has a substantially triangular configuration that fits between the curved outer walls of the first and second cavities and the inner surface of the hollow elongate member, so that the void region wraps around and spans both cavities.

4. The system of claim 3, wherein the void region is configured to span the first and second cavities by about 180 degrees in an azimuthal direction.

5. The system of claim 1, wherein the outer wall of at least one of the cavities is substantially flat.

6. The system of claim 1, wherein the cross section of the void region has a substantially non-triangular configuration.

7. A standing wave particle accelerating system, comprising:

a hollow elongate member extending along a beam axis;

a plurality of pairs of resonant cavities defined within the hollow elongate member, the cavities interconnected through a beam tube that extends along the beam axis to allow charged particles to pass therethrough;

wherein each pair of cavities includes: a first resonant cavity having a first resonant slot cut through its outer wall, and a second resonant cavity adjacent the first resonant cavity and having a second resonant slot cut through its outer wall; and wherein the first resonant slot and the second resonant slot are separated by a void region that extends between the outer wall of the first cavity and the outer wall of the second cavity and is bounded in part by the interior surface of the hollow elongate member; and wherein the second cavity is coupled to the first cavity through a dual slot coupling structure that includes the first resonant slot, the void region, and the second resonant slot.

8. The system of claim 7, further comprising an RF source configured to provide RF power to the cavities.

9. The system of claim 8, wherein each resonant cavity is configured to support an RF standing wave therewithin when provided with RF power from the RF source; and wherein each resonant cavity includes an accelerating gap defined therewithin, so that when RF power is received from the RF source, the voltage difference across the accelerating gap causes charged particles to be accelerated when they traverse the gap.

10. The system of claim 9, wherein the cavities are shaped and sized so that the center-to-center spacing defined by successive ones of the accelerating gaps within adjacent cavities is about $\beta\lambda/2$, where $\lambda$ is the free space wavelength of the resonant standing wave in the cavities and $\beta$ is the velocity of a particle passing through the cavity, normalized to the speed of light.

11. The system of claim 9, wherein the two resonant slots in each dual slot coupling structure are disposed in proximity to each other so that when RF power is provided by the RF source, the magnetic fields in the first and second slots are coupled and become confined within the void region, causing the dual slot structure to oscillate in one or more collective modes.

12. The system of claim 11, wherein the collective modes comprise one of: an in-phase mode in which the respective magnetic fields oscillate in phase, and an out-of-phase mode in which the respective magnetic fields oscillate out of phase.

13. The system of claim 7, wherein at least some of the resonant slots are capacitively loaded so as to limit their angular extent.

14. The system of claim 9, wherein the cavities and the resonant slots are configurable so that when RF energy is provided by the RF source, the electric fields in the acceleration gaps of adjacent cavities are out of phase and reversed in direction with respect to each other.

15. The system of claim 7, wherein the void regions in adjacent pairs of cavities are rotated by about 180 degrees relative to one another in the azimuthal direction, so that the two-slot coupling structures are located at alternate azimuthal angles of 0 and 180 degrees.

16. The system of claim 10, wherein the dual slot coupling structure is configured to resonate in one of a 0-phase advance mode and a $\pi$ phase advance mode, when the cavities adjacent to the dual slot coupling structure are detuned.

17. The system of claim 7, wherein the cavities are tunable to a resonant frequency of about 3 GHz.

18. The system of claim 7, wherein at least some of the cavities has an outer radius of about 3.94 cm.

19. The system of claim 7, wherein at least one pair has cavities that are separated from each other by a distance of about 6 mm, and a void region having a radial dimension of about 12.5 mm and a longitudinal dimension of about 20 mm.

20. The system of claim 7, wherein the plurality of cavities form a periodic sequence of coupled cavities that define a transmission line for charged particles; and wherein the size, shape, and resonant frequencies of the resonant cavities and the resonant slots are selectable so that the dispersion curve for the transmission line can be can be closed near a desired operating mode for the system, with adjacent accelerating gaps having electric fields that are out of phase.

21. The system of claim 7, wherein the thickness of the walls of the cavities is selectable so as to limit the angular extent of the void region.

22. A method comprising:

aligning a plurality of pairs of adjacent cavities along a beam axis;

for each pair, forming a resonant slot on the outer walls of each adjacent cavity, and separating the resonant slots by a void region that wraps around and spans both cavities by about 180 degrees in the azimuthal direction along the beam axis, thereby generating a dual slot coupling structure that includes the two resonant slots and the void region, and that couples the adjacent cavities to each other; and providing RF power to the plurality of cavities, causing the magnetic fields in the resonant slots in each coupling structure to be coupled and to become confined within the void region, and further causing the dual slot coupling structure to resonate in one or more collective modes in which the electric fields in acceleration gaps defined within the adjacent cavities are out of phase and reversed in direction with respect to each other.

* * * * *